United States Patent [19]

Raubenheimer

[11] Patent Number: 4,550,463

[45] Date of Patent: Nov. 5, 1985

[54] STEERING DEVICE FOR A SUCTION CLEANING APPLIANCE

[75] Inventor: Johann N. Raubenheimer, Bedfordview, South Africa

[73] Assignee: Peacock Investments (Proprietary) Limited, Johannesburg, South Africa

[21] Appl. No.: 610,849

[22] Filed: May 16, 1984

Related U.S. Application Data

[63] Continuation-in-part of Ser. No. 480,392, Mar. 30, 1983, abandoned.

[30] Foreign Application Priority Data

Jun. 16, 1982 [ZA] South Africa ..... 82/4243

[51] Int. Cl.[4] ..... E04H 3/20

[52] U.S. Cl. ..... 15/1.7; 134/166 R

[58] Field of Search ..... 15/1.7; 4/490, 492, 4/496, 507, 510; 134/166 R, 167 R, 168 R

[56] References Cited

U.S. PATENT DOCUMENTS

| | | | |
|---|---|---|---|
| 3,229,315 | 1/1966 | Watson | 15/1.7 |
| 3,512,540 | 5/1970 | Hughes | 134/167 R |
| 4,152,802 | 5/1979 | Chauvier | 15/1.7 |
| 4,434,519 | 3/1984 | Raubenheimer | 15/1.7 |

*Primary Examiner*—Edward L. Roberts

*Attorney, Agent, or Firm*—Ladas & Parry

[57] ABSTRACT

A suction cleaning head of the kind which is connected to a suction hose in use and lifts off a surface to move, is manually steered by means of a steering wheel at the upper end of the hose which connects to the suction connection through a swivel.

3 Claims, 1 Drawing Figure

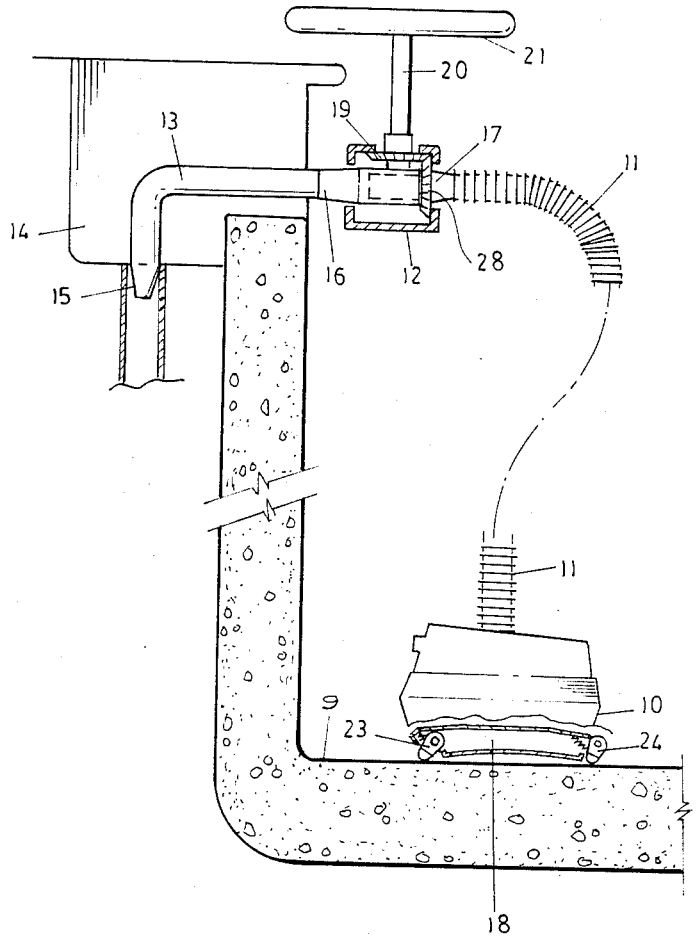
21
20
19
17
13
11
14
28
16
12
15
11
10
9
23
24
18

STEERING DEVICE FOR A SUCTION CLEANING APPLIANCE

This application is a continuation-in-part of U.S. patent application Ser. No. 480,392 filed Mar. 30, 1983, now abandoned.

BACKGROUND TO THE INVENTION

This invention relates to a steering device for an automatic suction cleaning appliance.

Suction cleaning appliances for submerged surfaces have already been proposed in which a cleaning head operates by applying lifting forces to the surface to be cleaned. Such appliances are disclosed in U.S. Pat. No. 4,434,519 and in the following U.S. patent applications: Ser. No. 480,360 filed Mar. 30, 1983, and Ser. No. 532,176 filed Sept. 14, 1983.

In using automatic cleaning appliances it has been found that at the end of a cleaning cycle there may still be a leaf or two lying on the surface to be cleaned either as a result of being disturbed during the cleaning cycle and thus being deposited elsewhere or as a result of having fallen in during a later stage of the cleaning cycle. To ensure a perfectly clean surface one then has to resort to a separate manual cleaning device.

The applicant has now found thah cleaning appliances of the kind disclosed in the abovementioned patent and pending applications can be fitted with a steering device so that they can operate in a manual cleaning mode making it unnecessary to use a separate manual appliance.

SUMMARY OF THE INVENTION

A steering device for a suction head for cleaning submerged surfaces which suction head is connected to a suction system by means of a flexible suction hose substantially normal to the surface to be cleaned and which has drive means which from time to time causes adhesion of the head to the surface to be cleaned, according to the invention comprises a rotary swivel for interposition between the suction system and the suction hose and a manually operated device fitted to the swivel by means of which the hose end connected to the swivel may be rotated.

DESCRIPTION OF THE DRAWINGS

It is a more or less diagrammatic section through a swimming pool showing the invention in action.

The drawing shows a cleaner head 10 operating according to the principles of U.S. patent application Ser. No. 480,360 filed Mar. 30, 1983. The head is marked 10 and is attached to a flexible suction hose along an axis normal to the surface 9 on which the head 10 moves.

As described in U.S. Ser. No. 480,360, the head 10 has side frames 18 to which pairs of feet 23 and 24 are pivoted. The side frames 18 rock and the feet 23 and 24 exert reciprocating forces oblique to the surface 9 so that the head 10 moves in a step by step manner. When the head 10 operates automatically, a motor in the head intermittently applies torque to a gear attached to the hose 11 which causes the head 10 to change direction in a random manner as the feet 23 and 24 cause it to move along.

The disclosure of U.S. patent application Ser. No. 480,360, filed Mar. 30, 1983, is hereby incorporated by reference.

At its other end the hose 11 is secured to a swivel box 12 which allows the hose 11 to rotate relatively to a bent standpipe 13 leading to a conventional suction socket 15 in a skimmer box 14.

As can be seen from the drawing the swivel box 12 surrounds two connectors 16 and 17 which are a rotary fit together. The connector 16 is fixed in the box 12 and is a tight fit in the pipe 13 while the connector 17 is a rotary fit in the box 12 and connects tightly with the hose 11. Around the connector 17 there is a bevel gear 28 which meshes with another bevel gear 19. The lower end of a steering column 20 clips into the centre of the gear 19 and its upper end carries a steering wheel 21. The steering column 20 can be made of any desired length, but in practice about 200 mm has been found to be adequate.

In use the head 10 is set to work in the normal way to move automatically and at random across the bottom of a swimming pool. Before removing the head 10, the steering wheel 21 is clipped on and any remaining leaves lying on the bottom are picked up by steering the head to them by means of the steering wheel 21. Users quickly acquire the knack of steering the head 10 by using the wheel 21.

I claim:

1. A steering device for a suction head for cleaning submerged surfaces which suction head is connected to a suction system by means of the flexible suction hose connecting with the head in a direction substantially normal to the surface to be cleaned and which has drive means which from time to time breaks adhesion of the head to the surface while causing the head to move, which steering device comprises a rotary swivel for interposition between the suction system and the suction hose, the swivel including a first member adapted to be fast with the suction system and the second member adapted to be fast with the suction hose and being rotatable relatively to the first member, and a manually operated device fitted to the second member by means of which the hose end connected to the swivel may be rotated.

2. The steering device claimed in claim 1 in which the device comprises a steering wheel and a steering column having opposed ends, one of said column ends being fast with the second member, and the steering wheel being fast with the other end of said column.

3. The steering device claimed in claim 2 in which the steering wheel is mounted to rotate about an axis transverse to the swivel and including a first bevel gear at the one end of the steering column, and a second bevel gear which meshes with the first bevel gear and which is fast around the second member.

* * * * *